US007069834B2

(12) United States Patent
Beal

(10) Patent No.: US 7,069,834 B2
(45) Date of Patent: Jul. 4, 2006

(54) TAPERED POWDER-BASED CORE FOR PROJECTILE

(75) Inventor: Harold F. Beal, Rockford, TN (US)

(73) Assignee: Doris Nebel Beal Inter Vivos Patent Trust, Pawleys Island, SC (US)

( * ) Notice: Subject to any disclaimer, the term of this patent is extended or adjusted under 35 U.S.C. 154(b) by 0 days.

(21) Appl. No.: 10/375,518

(22) Filed: Feb. 26, 2003

(65) Prior Publication Data

US 2003/0221580 A1 Dec. 4, 2003

Related U.S. Application Data

(60) Provisional application No. 60/359,817, filed on Feb. 26, 2002.

(51) Int. Cl.
*F42B 33/00* (2006.01)

(52) U.S. Cl. ..... 86/55; 102/516

(58) Field of Classification Search ..... 102/506, 102/507, 516, 517; 86/54, 55
See application file for complete search history.

(56) References Cited

U.S. PATENT DOCUMENTS 2,309,360 A * 1/1943 Southwell et al. ..... 86/55
2,393,648 A * 1/1946 Martin ..... 102/519
3,069,748 A * 12/1962 Nosler ..... 86/55
3,143,966 A * 8/1964 Burns, Jr. ..... 102/507
3,782,287 A * 1/1974 Sie ..... 102/516
4,352,225 A * 10/1982 Schreiber ..... 86/55
5,789,698 A 8/1998 Beal
5,847,313 A * 12/1998 Beal ..... 102/516
6,085,661 A 7/2000 Halverson et al.
6,317,946 B1 * 11/2001 Beal ..... 102/516
6,371,029 B1 4/2002 Beal
6,457,417 B1 10/2002 Beal

FOREIGN PATENT DOCUMENTS

GB 516895 * 1/1940 ..... 86/56

* cited by examiner

*Primary Examiner*—Stephen M. Johnson
(74) *Attorney, Agent, or Firm*—Pitts & Brittian, P.C.

(57) ABSTRACT

A powder-based projectile useful in the manufacture of gun ammunition comprising a jacket having an inner volume which is tapered from a maximum diameter adjacent the open end of the jacket to a minimum diameter adjacent the closed end of the jacket and a core formed outside the jacket and having a complementary tapered geometry with respect to the inner volume of the jacket. Projections from the outer surface of the core are embedded within the inner wall of the jacket to enhance the spin stability of the jacket/core combination and to enhance the frangibility of the projectile upon it striking a target. A method for the manufacture of the projectile is disclosed.

7 Claims, 2 Drawing Sheets

TAPERED POWDER-BASED CORE FOR PROJECTILE

RELATED APPLICATIONS

This application is a non provisional application based on Provisional application Ser. No. 60/359,817, filed Feb. 26, 2002.

FIELD OF INVENTION

This application relates to gun ammunition and particularly to projectiles for use in rounds of gun ammunition.

BACKGROUND OF INVENTION

Prior art projectiles for gun ammunition have been manufactured from a generally cup-shaped metal jacket having a closed end and an open end. Heretofore, solid metal or powder-based core or cores have been inserted into metal jackets and thereafter formed into projectiles. Powder-based cores commonly comprise a mixture of metal powders which are pressed into self-supporting compacts suitable for insertion into a jacket. Some such powder-based cores exhibit little or not material porosity. Alloys of multiple metals commonly are formed into solid cores of no material porosity.

The prior art metal jackets commonly are manufactured by drawing a strip of metal into the cup-shaped jacket. In these operations, the wall thickness adjacent the closed end of the finished jacket is thicker than the thickness of the side wall of the jacket, hence the inner diameter of the jacket is maximum adjacent the open end of the jacket and tapers to a minimum value adjacent the closed end of the jacket. In most such jackets, the tapering of the inner diameter of the jacket commences pronounceable about two-thirds of the distance from the open end of the jacket and continues to the closed end of the jacket.

In a jacket having a tapering inner wall diameter, insertion of a core of the prior art which is formed outside the jacket, into the jacket becomes a problem. Specifically, if the core is of a straight cylindrical geometry, as is true of prior art cores which are formed outside the jacket, and if the diameter of the core is chosen to be almost equal to the minimum diameter of the jacket so that the core can be inserted into the jacket to the extent that one end of the core will fill the closed end of the jacket interiorly of the jacket, major problems arise.

Specifically, if the circumferential rim of the end of the cylindrical core engages the inner circumference of the jacket before the core is fully seated within the jacket, there is formed a substantially air-tight seal between the rim of the core and the inner circumference of the jacket, trapping air between the inner end of the core and the closed end of the jacket. Further insertion of the core into the jacket develops pressurized air pockets within the jacket and frequently results in actual ejection of the core from the jacket over time.

On the other hand, if the maximum diameter of the core is chosen to approximately equal the minimum inner diameter of the jacket, this design leaves a substantial annular void between the core and inner wall of the jacket at a location between the open end of the jacket and that point along the inner wall of the jacket where the actual outer diameter of the core and the inner diameter of the jacket are substantially equal. Such voids produce impressible instability of the core within the jacket, among other things.

Still further, if the core is chosen to be of a diameter equal to the minimum inner wall diameter of the jacket at a location about two-thirds of the distance from the open end of the wall in the direction of the closed end of the jacket, the length of the core will result in a substantial portion of the length of the core projecting out of the jacket at the open end of the jacket. This core must then be "seated" by pushing it further into the jacket, commonly employing a punch and die operation. This procedure effects such deformity of the core and/or jacket as to permit the core to fill the jacket volume adjacent the closed end of the jacket. In the case of solid metal cores, this action deforms the metal to cause it to fill the closed end of the jacket. As noted, this action commonly develops impressible pressurized air pockets within the jacket adjacent the closed end thereof. In the case of powder-based cores wherein the core is frangible, as opposed to skittered cores, cores formed from metal alloys, and cores wherein one of the metal powders acts as a binder for the second metal powder, the seating of a core into the closed end of a jacket literally crushes a portion of the core so that the core must be "reformed" in the crushed area by the application of relatively high forming pressure being applied in the seating operation.

Further, once the core has been seated into the jacket, the open end of the core/jacket combination must be die formed to define an give on the leading end of the core/jacket combination to thereby complete the projectile.

SUMMARY OF INVENTION

In accordance with the present invention, the inventor overcomes the problems of the prior art by providing an elongated core having a tapered outer wall and formed outside the jacket. Depending upon the degree of taper within the interior of the jacket, there is provided more or less taper of the outer diameter of the core. In any event, preferably the maximum outer diameter of the core is substantially equal to, but not greater than, the maximum inner diameter of the jacket at the open end of the jacket, while providing for sufficient annular space between the outer diameter of the core and the inner diameter of the jacket as permits the ready insertion of the core into the jacket without developing a deleterious annular void between the core and the inner wall of the jacket. The minimum diameter of the tapered core is chosen to be substantially equal to, but not greater than, the minimum inner diameter of the jacket adjacent its closed end, thereby permitting that end of the core positioned most inwardly of the jacket to be initially inserted readily substantially fully into the jacket, with no portion of the core projecting outwardly from the open end of the jacket. Rather, the length of the core is chosen such that when the core is fully seated within the jacket, there is a portion of the jacket wall adjacent the open end of the jacket which is void of the core. This portion of the jacket wall commonly is subsequently deformed to define an give on that end of the jacket which was initially the open end of the jacket.

DETAILED DESCRIPTION OF INVENTION

Figure 1:
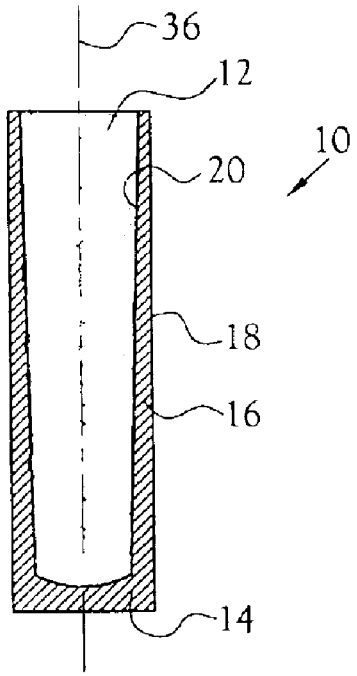
FIG. 1 is a side view, in section, of a metal jacket suitable for use in the present projectile.
Figure 2:
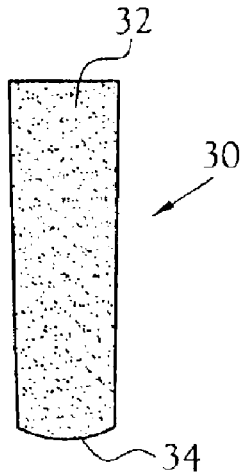
FIG. 2 is a side view of a powder-based core formed by cold pressing in a die outside the jacket, a mixture of heavy metal powder and a lighter metal powder into a self-supporting compact.
Figure 3:
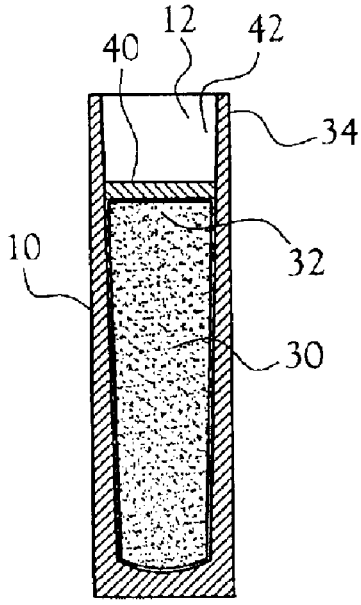
FIG. 3 depicts the core of FIG. 2 initially (non-seated) disposed within the jacket of FIG. 1 and including a metal disc overlying that end of the core adjacent the open end of the jacket.

Referring to the several Figures, in FIG. 1 there is depicted a prior art metal (copper) jacket 10 of generally cup-shaped geometry useful in the manufacture of a projectile for gun ammunition. The depicted jacket is sized for use in the manufacture of .223 caliber gun ammunition and includes an open end 12, a closed end 14 and a generally cylindrical wall 16 having a straight outer side wall 18 and a tapering inner side wall 20. The wall thickness of the jacket adjacent its open end is about 0.013 inch. The internal diameter of the depicted jacket adjacent its open end is about 0.198 inch and reduces to about 0.191 inch adjacent its closed end. The overall length of the jacket is about 0.930 inch.

In accordance with one aspect of the present invention, the inventor produces an elongated core 30 which tapers from a maximum outer diameter at one end 32 of the core to a minimum outer diameter at the opposite end 34 of the core. In the example of a core suitable for the manufacture of a .223 caliber projectile, the maximum outer diameter of the tapered core is about 0.196 inch and its minimum outer diameter is about 0.191 inch. This core has a length of about 0.831 inch, thereby providing 0.099 inch 34 of the length of the core unfilled by the core after the core is seated within the jacket. This "extra" length 34 of jacket wall is therefore available for infolding inwardly of the longitudinal center line 36 of the jacket to overlie and at least partially cover that end 32 of the core which is positioned adjacent the initially open end of the jacket.

In a preferred embodiment, the projectile of the present invention includes a disc 40, formed of a metal or plastic material, disposed within the jacket and overlying that end 32 of the core which is adjacent the initially open end of the jacket. This disc is of an outer diameter which is substantially equal to the inner diameter of the jacket in the region of the open end of the jacket and serves to block the movement out of the jacket of any loose powder particles from the core. By providing a length less than the length of the jacket and wherein the core is tapered such that it will readily fit within the jacket to at least proximate the closed end 14 of the jacket without externally applied axial pressure being exerted against the larger end of the core, the present invention provides a void volume 42 within the jacket adjacent the open end thereon into which the disc may be positioned prior to the core seating of the core. This feature is important for the automation of the process of loading the core and the disc into the jacket prior to core seating of the core within the jacket. It is further important in that the axial pressure needed to seat the core is applied also to the disc, partially deforming the disc to wedge the disc against the inner wall of the jacket and thereby lock the core within the jacket such that the jacket/core/disc combination may be handled during subsequent processing operations without disrupting the position of the core and without the escape from the jacket of any loose powder from the core.

In one embodiment, the tapered core of the present invention is useful in the manufacture of projectiles for the M855 armor penetrating gun ammunition of the type commonly employed in military operations. The prior art M855 projectile includes a pyramidal shaped steel perpetrator enclosed within the give formed from the closed leading end of a metal jacket, and a lead core disposed in tandem to the perpetrator. The initially open end of the jacket is infolded to a limited extent to retain the lead core, and the perpetrator, fully within the jacket during firing of projectile from a gun and during the flight of the projectile to a target.

In an M855 projectile 48 employing the present invention (see FIG. 5), the core 50 is formed of a mixture including a first metal powder having a density greater than the density of lead and a second metal powder having a density not greater than the density of lead. Tungsten metal powder mixed with tin metal powder, preferably with a non-metal matrix powder, provides a suitable mixture for die forming, at room temperature and outside the jacket, of a tapered core useful in either .223 or M855 projectiles, or other calibers of gun ammunition. By employing different mixes of tungsten metal powder and tin metal powder, one skilled in the art may form tapered cores of more or less density (GM/cc) ranging from 97%, by weight of tungsten powder to as much as about 10%, by weight, of tungsten powder, the remainder of the mixture comprising tin metal powder, and, in a preferred embodiment, between about 0.010% and about 1.5%, by weight of a non-metal matrix powder, such as micronized polyethyene of about 12 micron particle size. Preferably, the metal powders are each of predominately 325 mesh size particles and are blended to homogeniety prior to loading the mixture into a die for pressing of a core.

In a still further embodiment, a tapered core of the present invention is useful in the automation of the production of a projectile capable of subsonic flight to a target. In subsonic projectiles, it is required that the density (weight) of the projectile be relatively greater than the density required for supersonic ammunition so that a selected volume of a slow burning powder employed in a round of subsonic ammunition will propel the projectile the required distance from the gun, but only at subsonic velocity. It is to be noted that in any given caliber of ammunition, especially ammunition designed to be fired from a gun operating in either the semi-automatic or automatic mode, there is a maximum design overall length of a round of such ammunition. Moreover, heretofore it has problematic to die press a powder mixture into a single core having the requisite weight, so that two cores have been employed to obtain the requisite overall weight of the core (and resulting projectile). Inasmuch as even "straight-walled" jackets exhibit some degree of narrowing of their inner diameter in a direction from their open end toward their closed end, the process of manufacturing a subsonic projectile from two cores disposed in tandem within the jacket, required introduction of the first core into the jacket, conducting a core seating operation employing a punch fed into the interior of the jacket, followed by withdrawal of the punch, feeding of the second core into the jacket, and again performing a second core seating operation. One major concern with this prior art procedure is that tungsten powder particles can adhere to the distal end of the punch as it is withdrawn from the jacket following the first core seating operation, and these highly abrasive powder particles can create extreme wear on the tooling associated with the die pressing operations, including especially the second reciprocatory movement of the core seating punch out of and reentry into the jacket in the course of the second core seating operation. Employing the concepts of the present invention, the inventor has found it possible to form a single tapered core of the requisite density and which is of a length sufficiently less than the full length of the internal volume of an acceptable jacket for a given caliber of weapon as will permit initial insertion of the core into the jacket without core seating, and further will permit the introduction of a disc into the jacket in overlying relationship to the outmost end of the core prior to introduction of the punch into the jacket for performing the core seating operation. By this means, the distal end of the punch is never exposed to the powder of the core and does not serve to transfer powder from the jacket onto or into the apparatus employed in the core seating or subsequent die pressing operations. Moreover, by reason of the use of a tapered core in this embodiment, the overall process for the formation of a projectile useful in subsonic ammunition can be readily automated.

Figure 4A:
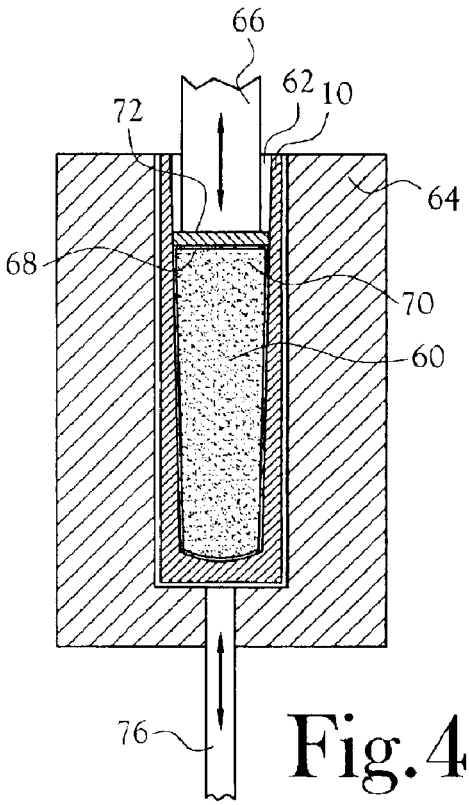
FIG. 4A depicts a step of seating a tapered core into a jacket having a closed end of minimum internal diameter.
Figure 4B:
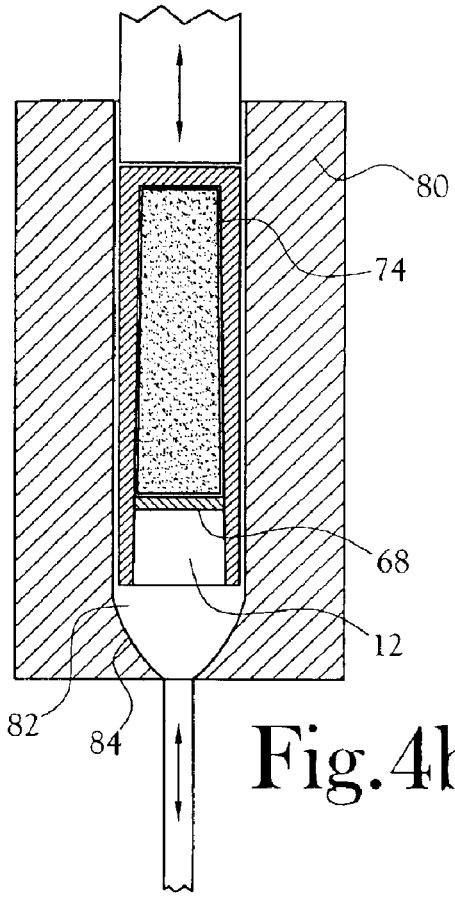
FIG. 4B depicts a step of die-forming an give on the initially open end of the jacket/core/disc combination formed in the step of FIG. 4A.
Figure 5:
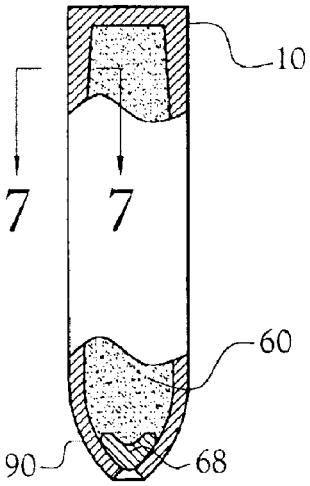
FIG. 5 depicts a completed projectile formed from the jacket/core/disc combination of FIG. 4B.
Figure 6:
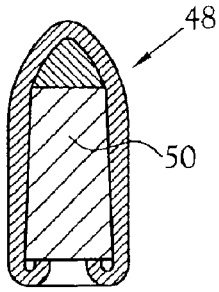
FIG. 6 depicts one embodiment of an M855 projectile embodying various features of the present invention.
Figure 7:
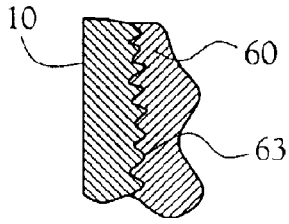
FIG. 7 is an enlarged sectional view of the interface between the inner wall of a jacket and the projections from the outer surface of a powder-based core as taken generally along the line 7—7 of FIG. 5.

Referring to FIGS. 4A–4B, in one embodiment of a method for the production of a projectile having a tapered core 60, a metal jacket 10 is positioned within the cavity 62 of a die 64, a punch 66 is inserted into the open end of the jacket, and employing axially applied pressure via the punch to a disc 68 disposed between the outermost end 70 of the core 60 and the distal end 72 of the punch, the core is seated within the jacket. This operation requires only a relatively low pressing pressure to effectively force the smaller outer diameter end of the core to substantially fully fill the internal volume of the jacket between the opposite ends of the core (and disc). Further, this operation deforms the core substantially uniformly radially outwardly to engaging relationship with the inner wall of the jacket, thereby eliminating any annular void(s) between the core and the jacket wall. It will be recognized that this deformation of the core need only effect about 0.001 inch increase in the overall diameter of the core, hence there is not material alteration of the overall length of the core. This action, however, does generate stress lines within the core itself which are desirable when producing a frangible projectile and further expands the diameter of the core to establish physical embedment of powder particles 63 (FIG. 7) projecting from the core into the inner wall of the jacket. Thereafter the jacket/core/disc combination 74 is removed from the die 64 as by means of the die punch 76, and inserted into a further die 80 with the open end 12 of the jacket being innermost within the cavity 82 of the further die. This further die is provided with an give-defining portion 84 of the die cavity and upon the application of axially applied pressure to the closed end of the jacket/core/disc combination, at least the open end 12 of the jacket, the disc 68 and a portion of the maximum diameter end of the core, are forced into the give portion of the die cavity to at least substantially closed the formerly open end of the jacket and impart a desired give geometry to the projectile as seen in FIG. 5. This operation also deforms the disc 68 into a generally hemispherical geometry having a hollow center into which powder from the core is caused to move, the deformed disc serving to at least partially close the formerly open end of the jacket. In at least one embodiment, the deformation of the disc is limited to the extent that there is a partial void remaining adjacent the open end of the jacket, this void serving to enhance disintegration of the jacket and core upon the projectile striking a target. In another embodiment, the deformation of the disc is such as fully fills and closes the open end of the jacket, rendering the projectile more useful as a perpetrator type round of ammunition.

FIG. 5 depicts one embodiment of a projectile which includes various of the features of the present invention and includes a metal jacket 10, a tapered core 60 contained therein, and a metal (tin, for example) disc 68 which has been deformed to at least partially close the formerly open end of the jacket. The depicted projectile further exhibits an give portion 90 at the leading end of the projectile.

One of the benefits or the projectile of the present invention is its inherent accuracy during flight to a target. In this respect, it will be noted that the compression of the core when core seating the core is applied axially of the core. Further, this axial pressure need not be sufficient to adversely crush the core and generate "loose" powder within the jacket, particularly adjacent the closed end of the jacket. Because of these features, the distribution of the axial pressure upon the core is uniformly distributed within the core and the core substantially retains its original pressed geometry, hence retains its original uniformity of density distribution of the multiple powder particles throughout the body of the core. For these reasons, the resultant projectile enjoys an enhanced uniformity of density distribution, hence enhanced spin stability when fired from a rifled barrel of a weapon.

Still further, because powder particles 63 (FIG. 7) at the outer surface of the tapered core of the present invention are intimately pressed against the inner wall of the jacket during core seating, the jacket is contained within a die cavity and therefore can not yield laterally of the jacket, those powder particles, particularly those tungsten powder particles disposed on the outer surface of the core become embedded within the soft metal (copper commonly) jacket. By reason of this mechanical association of the powder particles and the inner wall of the jacket, when the spinning projectile strikes a solid or semi-solid target, the rapidly spinning powder particles of the core substantially instantaneously disperse generally laterally of the projectile path. Each of those metal powder particles which are embedded in the wall of the jacket carries with it a minute portion of the jacket wall, hence enhancing disintegration of the jacket.

Whereas the present invention has been described employing specific details and examples, various modifications and equivalents will be recognized by one skilled in the art. Specifically, it will be recognized by one skilled in the art that different manufacturers of jackets, or even different lots of jackets from a single manufacturer, will contain jackets which taper more or less than the examples provided herein, but the concepts of the present invention are applicable irrespective of the degree of taper of a jacket.

What is claimed:

1. A method for the manufacture of a projectile useful in the manufacture of gun ammunition comprising the steps of:

disposing a cup-shaped, open ended jacket within a first die cavity, said jacket having a closed end, a longitudinal centerline, and an inner wall, forming a metal powder-based core outside said jacket, said core having an outer wall which is substantially geometrically complementary to said inner wall of said jacket, a longitudinal said centerline, and including a multitude of metal powder particulates projecting from said outer wall, inserting said core into said jacket with the core oriented coaxially within the inner wall of said jacket, and with their longitudinal centerlines aligned, applying an axially aligned force against said core to seat said core within said jacket, with concomitant resultant embedment of portions of said projecting metal powder particulates of said core into the thickness of said inner wall of said jacket.

2. The method of claim 1 and including the step of removing said jacket/core combination from said first die cavity, inserting said open end of said jacket into a second die cavity having an ogive geometry, and applying an axially directed force to the closed end of said jacket to define an ogive on the open end of said jacket.

3. The method of claim 2 wherein the formation of said ogive is terminated short of complete closure of said open end of said jacket.

4. The method of claim 1 and including the steps of inserting a disc within said jacket adjacent said open end of said jacket and outboard of said core.

5. The method of claim 1 wherein said outer wall of said core and said inner wall of said jacket are complementarily tapered from respective maximum diameters to respective minimum diameters.

6. A method for the manufacture of a projectile useful in gun ammunition comprising the steps of providing a cup-shaped jacket having a longitudinal centerline, an open end and a closed end, an interior hollow cavity of a first geometry, and an outer geometry, disposing said jacket within a die cavity having an interior geometry for receiving said jacket therein with said outer geometry of said jacket being in intimate engagement with said interior geometry of said die cavity and with said open end of said jacket being exposed to the environment ambient to said die cavity, disposing a metal powder-based core having a longitudinal centerline within said jacket via said open end thereof, with said longitudinal center line of said core substantially aligned with said longitudinal center line of said jacket, said core comprising a self-supporting compact having an outer geometry which is complementary to said interior geometry of said jacket, said compact being formed from a quantity of a mixture of a first metal powder having a first density and a second metal powder having a density less than said density of said first metal powder, each of said metal powders comprising respective multiplicities of individual particulates of respective ones of said metal powders, said particulates of said first and second metal powders being substantially uniformly dispersed throughout said mixture thereof, said core having individual ones of said first metal powder particulates exposed about and projecting from, the outer surface of said core, urging said core substantially fully into said jacket employing a force applied axially along the longitudinal centerline of said core, thereby seating said core within said jacket with concomitant resulting embedment of at least a portion of respective ones of said multitude of said exteriorly exposed first metal particulates of said core, into said inner wall of said jacket, thereby mechanically fixing said core to said jacket at multiple spaced apart locations about the outer circumference of said core.

7. The method of claim 6 wherein the embedment of said respective ones of said multitude of first metal particulates of said core impart frangibility to said jacket when said core/jacket combination is incorporated into a projectile for a round of ammunition and said projectile strikes a target following the firing of said round of ammunition in a weapon.

* * * * *